United States Patent [19]

Myers

[11] 4,407,026

[45] Oct. 4, 1983

[54] FLUSH CONTROL MECHANISM FOR TOILET TANK

[76] Inventor: Robert E. Myers, 1446 Fourth St., Monongahela, Pa. 15063

[21] Appl. No.: 405,157

[22] Filed: Aug. 4, 1982

[51] Int. Cl.[3] ..... E03D 1/02

[52] U.S. Cl. ..... 4/365; 4/363

[58] Field of Search ..... 4/363, 365, 661, 353

[56] References Cited

U.S. PATENT DOCUMENTS

| | | | |
|---|---|---|---|
| 661,171 | 11/1900 | Gautier | 4/365 |
| 1,082,056 | 12/1913 | Wangelin | 4/365 |
| 1,083,782 | 1/1914 | Radich | 4/365 |
| 2,644,950 | 7/1953 | Chapman | 4/365 |
| 2,762,059 | 9/1956 | Jahn | 4/365 |
| 3,842,444 | 10/1974 | Gruenhagen | 4/363 |

*Primary Examiner*—Henry K. Artis

*Attorney, Agent, or Firm*—Watson, Cole, Grindle & Watson

[57] ABSTRACT

A flush control mechanism for a toilet tank includes a pivotable control element which is pivotable about a generally horizontal axis in the tank, a trip lever mechanism, a fill water valve element which is connected to both the pivotable control element and the main water supply pipe which extends into the toilet tank, and an adjustable valve element. The pivotable control element includes a weightbox which is divided by a baffle into a water inlet chamber and a water outlet chamber, the floor of the weightbox including a drain hole which communicates with the water outlet chamber. The fill water valve element includes a primary nozzle for discharging fresh water directly into the toilet tank and a secondary nozzle for discharging fresh water into the water inlet chamber of the pivotable control valve element, as well as a control arm which is connected to the end of the pivotable control valve element. The adjustable valve element is employed to adjust the flow of fresh refill water which flows from the secondary nozzle of the fill water valve element to the water inlet chamber of the weightbox.

10 Claims, 5 Drawing Figures

FLUSH CONTROL MECHANISM FOR TOILET TANK

BACKGROUND OF THE INVENTION

1. Field of the Invention

The present invention relates to a flush control mechanism for a toilet tank, and more specifically to a flush control mechanism which can operate to move the stopper from blocking relationship with the drainage opening in the bottom of the toilet tank and to control the supply of fresh water to the toilet tank by way of the pivotal movement of a control element located inside the toilet tank.

2. The Prior Art

Many different types of flush control mechanisms have been invented which can be used in toilet tanks to open and close the drainage opening in the bottom of the tank and thereby control the flow of flush water to the toilet bowl therebelow, as well as to control the supply of fresh water to the toilet tank from the main water supply pipe which connects therewith. Some types of flush control mechanisms are more complicated and expensive than others, although not necessarily more durable or reliable.

One type of flush control mechanism makes use of a control valve element which is in the form of a container that is divided into chambers and is pivotable about a generally horizontal axis inside the toilet tank, the pivoting of the container about the generally horizontal axis being based on the relative amounts of water in the various chambers. Depending on the orientation of the container about the horizontal axis, the drainage opening at the bottom of the toilet tank will be either opened or closed and a main water inlet valve connected to the main water supply pipe either opened or closed.

For example, U.S. Pat. No. 1,475,841 shows a flush control mechanism for a toilet tank which includes a rectangular boy that is divided by a low transverse partition into a left side water inlet chamber and a right side water outlet chamber, the rectangular box being pivotable about a horizontal axis which is located below the center of gravity of the box and closer to its left end than its right end. The right end of the box includes a drain hole which is coincident with a frame extending above the drainage opening of the toilet tank, together with an internal ball valve for opening and closing the drainage hole. A link connects the left side of the box to a valve attached to the main water supply pipe to supply water to the left side water inlet chamber of the box when appropriate. Assuming that the box contains the necessary amount of water and is in its inactive position, i.e., horizontally disposed within the toilet tank, the flush control mechanism is operated as follows: a handle lever on the front of the toilet tank is raised, thus releasing the box so as to allow it to pivot about the horizontal axis in a clockwise fashion. The frame above the tank drainage opening will raise the ball of the ball valve in the right side water chamber of the box to thereby allow water to drain through the drain hole therein and then through the tank drainage opening to pass downwardly to the toilet bowl therebelow. Once a sufficient amount of water has drained out of the right side water outlet chamber, the weight of water remaining in the left side water inlet chamber will cause the box to pivot back about the horizontal axis in a counterclockwise fashion, such that its left side end hits the toilet tank floor. At this point the main water inlet valve on the main water supply pipe is opened so as to supply fresh water to the left side water chamber of the box. Once the box has been filled with the needed amount of water, it will pivot again in a clockwise fashion about the horizontal axis to its inactive, horizontal position, the handle lever preventing any further pivoting of the box. At the same time, the main water inlet valve will be concurrently caused to close.

A different construction of flush control mechanism is shown in U.S. Pat. No. 3,003,156. This flush control mechanism includes a container that is divided by walls into a left side water chamber and a right side water chamber, the container being pivotable about a horizontal axis located at its left end. The left side water chamber includes a relatively small drainage orifice. When in its rest position the container will be submerged in the water contained in the toilet tank and thus filled with water, as well as in blocking position with respect to the drainage opening in the floor of the tank. When pivoted in counterclockwise fashion about the horizontal axis by operation of the crank on the front of the tank, the water in the toilet tank will drain through the tank drainage opening. As the tank water level lowers, the water in the left side water chamber of the container will drain out through the drain orifice until the weight of water remaining in the right side water chamber is sufficient to pivot the container back to its inactive, starting position. A valve and float assembly operates to control the supply of fresh refill water to the tank.

It is an object of the present invention to provide a flush control mechanism for a toilet tank which is reliable, inexpensive and easy to install, and which can be conveniently adjusted so as to control the amount of water which will be drained from the tank to the bowl therebelow and the time needed to refill the tank with fresh water.

SUMMARY OF THE INVENTION

According to the present invention the flush control mechanism includes a pivotable control element which is pivotable about a generally horizontal axis located above the normal water level in the toilet tank and, based on its orientation about the generally horizontal axis, is capable of controlling the operation of a fill water valve element; a trip lever mechanism which when operated by a user is capable of rotating the pivotable control element about the generally horizontal axis and also of moving the toilet tank stopper so as to open the drainage opening of the toilet tank; a fill water element which is connected to the upper end of the main water supply pipe in the toilet tank, this fill water valve element being capable of controlling the supply of fresh refill water to both the toilet tank and the pivotable control element, i.e., based on the orientation of the noted pivotable control element about the generally horizontal axis; and an adjustment valve element which is suitably connected and adjustable to determine the flow rate of fresh refill water which can pass therethrough to the pivotable control element when the fill water valve element is activated. The inventive flush control mechanism may also include a mounting element which provides the generally horizontal axis about which the pivotable control element can rotate. Each element of the flush control mechanism is made of sturdy and corrosion-resistant materials, such as hard plastic materials and/or metallic materials (e.g. brass or stainless steel).

Considered in more detail, in a preferred embodiment the pivotable control element is constructed to include a rectangular weightbox which is internally divided by a transversely extending baffle into a water inlet chamber and a water outlet chamber, the floor of the weightbox including a drain hole which communicates with the water outlet chamber. In addition, the pivotal control element includes a bracket device which is attached to the weightbox to enable it to suitably pivot about the generally horizontal axis, a connector element which is attached to the weightbox to enable it to be operatively connected with the fill water valve element so as to control the operation of the fill water valve element, and a fresh water infill tube which is connected between the weightbox and the fill water valve element to enable fresh refill water to flow from the fill water valve element into the water inlet chamber of the weightbox.

The trip lever mechanism includes a manually-operable tip handle which extends through the front wall of the toilet tank, a lever arm located inside the tank and to which the upper end of the toilet tank trip chord is attached, and a lifting arm which is capable of lifting the weightbox and thus cause it to rotate about the generally horizontal axis.

The fill water valve element includes a threaded inlet neck which enables the fill water valve element to be sealingly connected to the upper end of the main water supply pipe in the toilet tank, a primary nozzle for discharging fresh refill water directly into the tank, a secondary nozzle for delivering fresh refill water to the pivotable control element, and a control arm for activating the valve element, i.e., for simultaneously opening and closing the primary and secondary nozzles.

The adjustment valve element includes a manually-operable control knob which can be adjusted to determine the opening of the flow passage therein and thus the flow rate of fresh refill water supplied to the pivotal control element from the fill water valve element.

In addition to the noted elements, the inventive flush control mechanism may, in a preferred embodiment, also include a mounting element which is positionable in the toilet tank, the mounting element being constructed to include a support member to provide the generally horizontal axis about which the pivotable control box will pivot.

With the inventive flush control mechanism operatively mounted in a standard toilet tank, i.e., such that each element thereof (except perhaps the mounting element) is located above the normal water level therein, and such that the weightbox is in its inactive (essentially horizontal) orientation about the generally horizontal axis (the water inlet chamber of the weightbox containing the necessary amount of water and the water outlet chamber being essentially empty) and the fill water valve element is in its inactive (closed) state, the pivoting (activation) of the weightbox of the pivotable control element by operation of the trip lever mechanism will cause the following events to occur in simultaneous fashion:

(1) The toilet tank stopper will be lifted upwardly by the toilet tank trip chord connected to the trip lever mechanism to unblock the toilet tank drainage opening, thus allowing the water in the toilet tank to rapidly drain downwardly therethrough by gravity to flush the toilet bowl in a normal fashion.

(2) The water in the water inlet chamber of the weightbox of the pivotable control element will flow over the baffle therein into the water outlet chamber (this occurring because the pivoting of the pivotable control element will cause the water inlet chamber to be rotated about the generally horizontal axis in see-saw fashion above the water outlet chamber).

(3) The water entering the water outlet chamber from the water inlet chamber will start draining through the drain hole in the weightbox to mix with the water remaining in the toilet tank.

(4) The fill water valve element will be activated (opened), such that fresh refill water will start flowing at a relatively high rate through the primary nozzle into the toilet tank and at a relatively low rate through the second nozzle and through the adjustment valve element to the water inlet chamber to the weightbox.

Once the weight of water which has accumulated in the water inlet chamber of the weightbox exceeds the weight of water left in the water outlet chamber (the amount of time before this occurs being determined by the adjustment of the adjustment valve element), the pivotable control element will pivot again about the generally horizontal axis back to its inactive (essentially horizontal) orientation. This action will then cause the fill water valve element to be inactivated (closed), thus discontinuing the supply of the fresh refill water to the tank via the primary nozzle. However, by this time the tank will already have become refilled with fresh refill water, i.e., since the rapid drainage of water through the toilet tank drainage opening noted in (1) above will have allowed the toilet tank stopper to fall downwardly to again block the drainage opening well prior to the time the pivotal control element has been pivoted to its inactive position. One complete operational cycle of the flush control mechanism will have been completed.

Further aspects, features and advantages of the present invention will be understood by reference to the accompanying drawings taken in conjunction with the following discussion.

DETAILED DESCRIPTION OF THE PREFERRED EMBODIMENT

Figure 1:
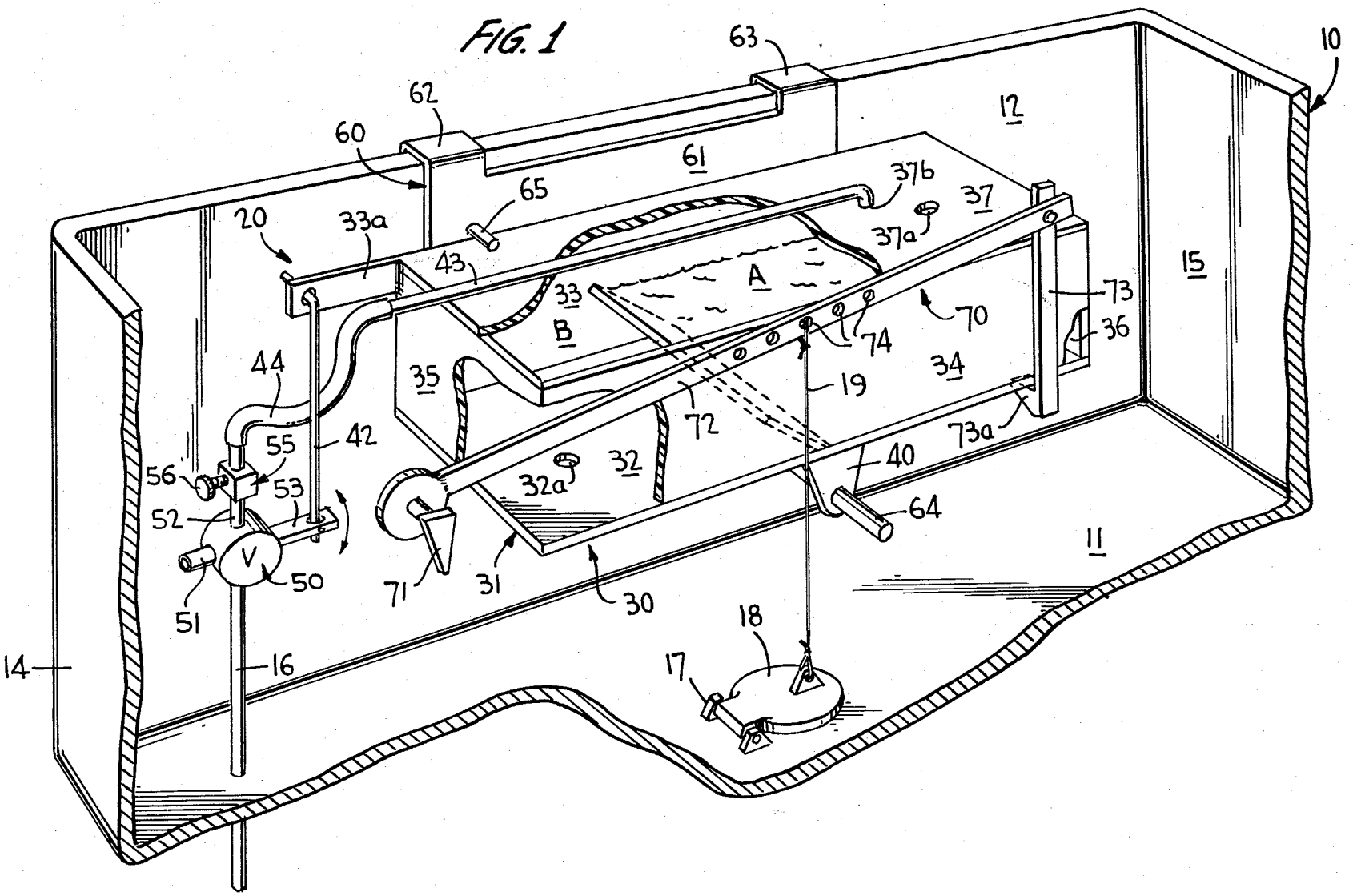
FIG. 1 shows a perspective view of a flush control mechanism according to one embodiment of the present invention, the flush control mechanism being operatively mounted in a standard toilet tank.
Figure 3:
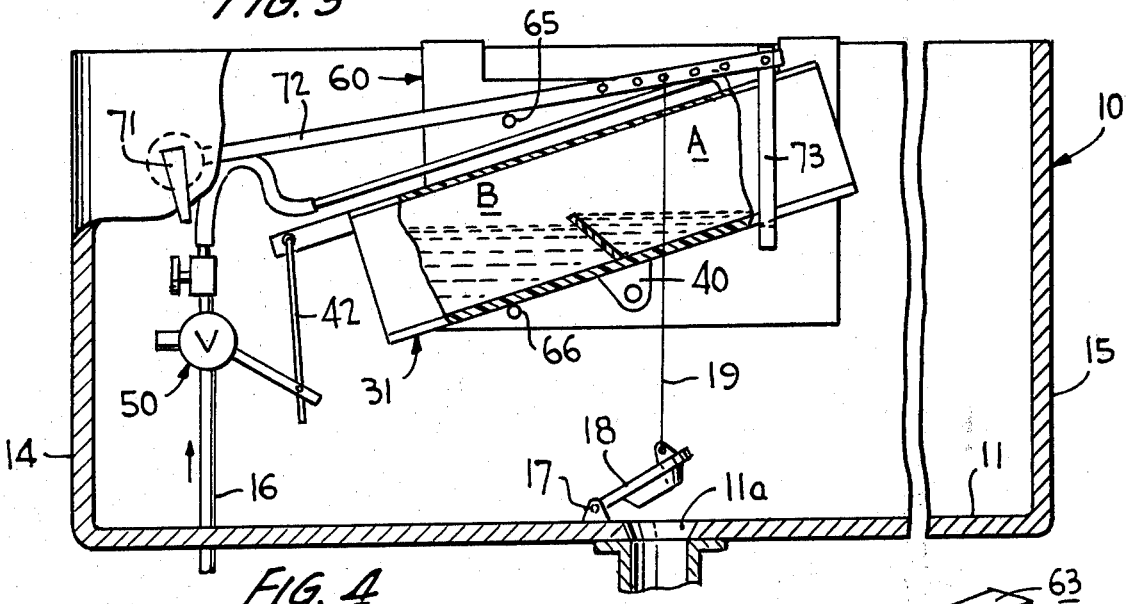
FIG. 3 shows a similar view to that of FIG. 2, but wherein the inventive flush control mechanism is in its activated position.

As can be seen in FIG. 1, the flush control mechanism of the present invention, generally labeled 20, is designed for operation in a tank 10 of a standard flush toilet. This tank 10, which is located above a standard toilet bowl (not shown), includes a floor 11, a rear wall 12, a front wall 13 (see FIG. 4), a left side wall 14 and a right side wall 15. The open top of the tank can be covered by a lid (not shown) which is dimensioned to extend over the upper ends of the walls 12, 13, 14 and 15 so as to enclose the interior of tank 10. The floor 11 of the tank includes a central drainage opening 11*a* (see FIG. 3) which feeds into a downwardly extending flow channel leading to the toilet bowl, as well as an inlet opening 11*b* through which a main water supply pipe 16 sealingly extends in order to supply fresh water into the interior of the tank 10. A bracket 17 is attached to the floor 11 near the drainage opening 11*a* and a stopper 18 is provided so as to cover the drainage opening, the stopper 18 being pivotally connected to the bracket 17 nd upwardly movable by means of a trip chord 19. The bracket 17 controls the movement of the stopper 18 such that it can be pivoted into and out of blocking engagement with the draingae opening 11*a*. Based on the location of stopper 18 with respect to the drainage opening 11*a*, water within tank 10 will be either retained therein or allowed to drain through the drainage opening 11*a* to flush the toilet bowl therebelow.

Referring now to the structure of the flush control mechanism 20, it is seen to include a pivotable control element 30, a fill water valve element 50, an adjustable valve element 55, and a trip lever mechanism 70. Also shown in the Figures as part of the inventive flush control mechanism is a mounting element 60. Each of these parts of the inventive flush control mechanism is made of sturdy and corrosion-resistant materials, these materials including hard plastics and metals, such as brass and stainless steel.

Figure 4:
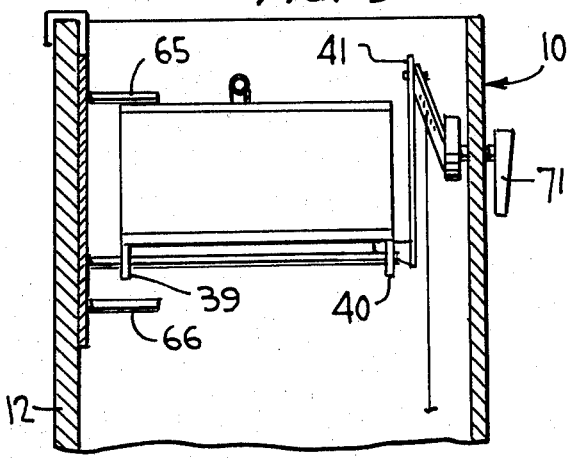
FIG. 4 shows a side view of the inventive flush control mechanism and toilet tank as seen along line 4—4 in FIG. 2.
Figure 5:
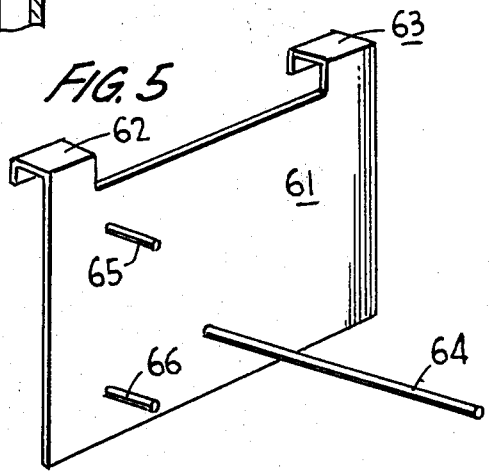
FIG. 5 shows a perspective view of the mounting element of the inventive flush control mechanism.

Referring first to the mounting element 60, which is best shown in FIG. 5, it is seen to include a flat plate 61 which includes rearwardly extending L-shaped mounting flanges 62 and 63 at its upper end, and a straight support rod 64 which extends generally perpendicularly away from its front side. The plate 61 also includes two vertically spaced apart upper and lower abutment stops 65 and 66 which generally perpendicularly away from the front side of the plate 61. As shown in FIG. 4, when the mounting element 60 is positioned inside the toilet tank 10, such that the mounting flanges 62 and 63 are seated on the upper end of the tank rear wall 12, the plate 61 will extend downwardly into the tank and the support rod 64, as well as the upper and lower abutment stops 65 and 66, will extend generally horizontally into the interior of the tank.

The fill water valve element 50, which is best shown in FIG. 1, includes a threaded inlet neck (not labeled) which allows the valve element to be sealingly attached to the top of the main water supply pipe 16, a primary nozzle 51 which is capable of discharging a relatively high flow rate of fresh refill water into the toilet tank, a secndary nozzle 52 which is connectable, via the adjustable valve element 55, to the pivotable control element 30 to supply a relatively low flow rate of fresh refill water thereto, and a control arm 53 which is operable to activate (open) or inactivate (close) the valve element and thus simultaneously control the flow of fresh water through the primary and secondary nozzles.

The adjustable valve element 55, best seen in FIG. 1, is in the form of a needle valve which is connected between the secondary nozzle 52 of the fill water valve element 50 and the flexible tube 44 of the water infill tube of the pivotal control element (discussed below). This valve element 55 includes a manually-operable knob 56 which can be adjusted to determine the opening of the flow channel therein, thus determining the flow rate of fresh refill water which can flow therethrough from the fill water valve element to the pivotable control element.

The trip lever mchansim 70 is sen in FIG. 1 to include a manually-operable trip handle 71 which extends through an opening in the left side of the front wall 13 of the toilet tank, as well as a lever arm 72 which is positioned in the tank to extend from the trip handle 71 towards the right side wall 15. Pivotally attached to the free end (the end nearest the right side wall 15) of the lever 72 is a downwardly extending lifting arm 73 which is generally L-shaped, the bottom portion 73*a* being capable of contacting and lifting the bottom wall 32 of the weightbox below the water inlet chamber therein. In addition, a number of holes 74 are located along the length of the lever arm 72 to provide attachment locations for the upper end of the toilet tank trip chord 19.

Figure 2:
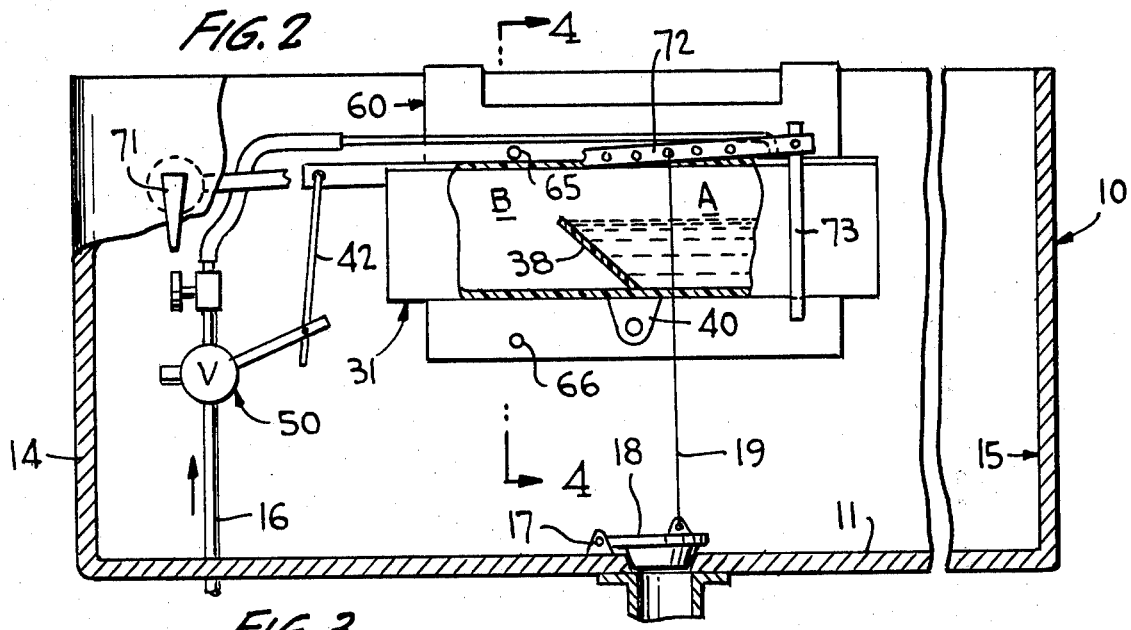
FIG. 2 shows a front elevational view of the inventive flush control mechanism and a toilet tank of FIG. 1, the flush control mechanism being in its inactive position.

Referring now to the pivotable control element 30, it is seen to include a rectangular weightbox 31 formed by a bottom wall 32, a rear wall 33, a front wall 34, a left end wall 35, a right end wall 36 and a top wall 37, and a baffle 38 which extends transversely across the weightbox from the rear wall 33 to the front wall 34 to divide its interior into a right side water inlet chamber A and a left side water outlet chamber B (see FIG. 2). The baffle 38 is located at a point about halfway between the end walls 36 and 37; however, it is tilted towards the left end wall 36 such that it encloses an angle of about 45° with respect to the portion of the bottom wall 32 which forms the water outlet chamber B. At the same time, the baffle 48 does not extend all the way to the top wall 37; thus, when the weightbox 31 is pivoted in a counterclockwise direction (see FIG. 3), the water in water inlet chamber A will flow over the baffle plate 38 and into the water outlet chamber B.

As can be seen in FIG. 1, the top wall 37 of the weightbox 31 includes a vent hole 37*a* for the interior of the weightbox, and an opening 37*b* above the water inlet chamber A through which fresh refill water can flow, as well as a drain hole 32*a* in the center of the bottom wall 32 and near the left end wall 35 so as to communicate with the water outlet chamber B.

A bracket means is attached to the exterior of the bottom wall 32 of the weightbox 31, this bracket means being in the form of two brackets 39 and 40 (see FIG. 4) which are aligned along a line extending transversely of the weightbox about halfway along its length, each of the brackets including a hole through which the support rod 64 of the mounting element 60 extends. In addition, a connector means, shown in the form of an extension arm 33*a* and a connector rod 42, is attached to the left side of the weightbox, the connector means connecting the weightbox to the control arm 53 of the fill water valve element 50. More particularly, the extension arm 33*a* extends away from the rear wall 33 of the weightbox 31 along its end which is adjacent the left end wall 35, and the upper end of the connector rod 42 is pivotally connected to a hole in the extension arm 33*a* while its lower end is connected to the control arm 53.

Finally, a water infill tube, shown in the form of a combined rigid tube 43 and a flexible tube 44, is connected between the weightbox 31 and the fill water valve element 50. More specifically, one end of the rigid tube 43 is sealingly connected in the opening 37*b* in the top wall 37 of the weightbox and is constructed to extend in parallel with the top wall 37 to a point beyond the left end wall 35, and the flexible tube 44 is sealingly connected between this free end of the rigid tube 43 and the adjustable valve element 55, which is connected to the secondary nozzle 52 of the fill water valve element 50.

Now, assuming that the inventive flush control mechanism is connected to the existing parts of the toilet tank as shown in FIG. 1 and the flush control mechanism is in its inactive position shown in FIGS. 1 and 2, such that (a) the top wall 37 of the weightbox 31 abuts against the upper abutment stop 65 of the mounting elements 60, (b) the toilet tank 10 contains the normal amount of water above the floor 11 (and below the support rod 64), (c) the water inlet chamber A of the weightbox 31 contains the necessary amount of water, and (d) the water outlet chamber B is essentially empty, the inventive flush control mechanism is activated as follows: The user rotates trip handle 71 of the trip lever mechanism 70 so as to move the lever arm 72 in a clockwise direction, and this causes a number of things to immediately happen: as a result of concurrent upward movement of trip chord 19, the stopper 18 is lifted (pivoted) out of its blocking position in drainage opening 11*a*, thus allowing the water in tank 10 to rapidly flow through the drainage opening to the bowl therebelow (note: after the user has released the trip handle 70 of the trip lever mechanism, the lever arm 72 will fall downwardly again to its inactive position, thus releasing the tension created in the trip chord 19, and once a sufficient amount of water has drained through the drainage opening 11*a*, the stopper 18 will pivot downwardly to a blocking relationship to the drainage opening). At the same time, due to the action of the L-shaped lifting arm 73 of the trip lever mechanism 70 on the weightbox 31, the weightbox is pivoted in a counterclockwise fashion about the support rod 64, such that it is oriented to a position shown in FIG. 2 (its bottom wall 32 abutting against the lower abutment stop 66 of the mounting element 60). Such movement of the weightbox 31 will cause the water inlet chamber A to be rotated in see-saw fashion above the water outlet chamber B, causing water in the water inlet chamber A to spill over the baffle plate 38 and into the water outlet chamber B, this water almost immediately starting to drain out of the drain hole 32*a* towards the floor 11 of tank 10. At the same time, the extension arm 33*a* will move downwardly, causing the connector rod 42 to move the control arm 53 of the fill water valve element 50 downwardly to thereby activate (open) this valve. Fresh refill water from main water supply pipe 16 will immediately flow through the primary discharge nozzle 51 directly into the tank 10 to replace water which has drained through drainage opening 11*a*, as well as through the secondary nozzle 52 and, via the adjustable valve element 55, the flexible tube 43 and the rigid tube 44, to refill the water in water inlet chamber A of the weightbox 31. Once a sufficient amount of water has drained out of the water outlet chamber B, the water in water inlet chamber A will counter-balance the water which is left in water outlet chamber B, and the weightbox will again pivot in a clockwise fashion about the support rod 64 to its inactive, generally horizontal position (shown in FIGS. 1 and 2). This will cause the extension arm 33*a* to move upwardly, thereby shutting off the fill water valve element 50. Most or all of the residual water in water outlet chamber B will drain through drain hole 32*a* to help achieve the normal water level in tank 10. A complete use cycle of the flush control mechanism will have been achieved.

As noted previously, the amount of water contained in tank 10 and the time during which the inventive flush control mechanism will be in its activated position will be easily adjusted by the setting of the adjustment valve element 55. In this way, the flushing of the toilet bowl and the refilling of the toilet tank 10 can be effectively and easily achieved.

Although one embodiment of the present invention has been now shown and described in detail, it should be remembered that numerous changes therein can be accomplished and yet still fall within the scope of the appended claims. For example, the adjustment valve element 55, instead of being connected between the secondary nozzle 52 of the fill water valve element 50 and the water infill tube of the pivotable control element 30, can be connected in the water infill tube itself. In addition, the mounting element 60, when considered to be part of the invention, instead of being constructed to be mountable on the upper end of the rear wall 12, can be constructed aso as to be supportable on the floor 11 of the tank.

I claim:

1. A reliable and easily adjusted flush control mechanism for a toilet tank which includes a drainage opening, a stopper for the drainage opening, a trip chord attached to the stopper and a main water supply pipe, said flush control mechanism including a pivotable control element, a manually-operable trip lever mechanism, a fill water valve element and an adjustable valve element, said pivotable control element comprising (a) a weightbox which is pivotally mountable about a generally horizontal axis located above the main water level in the toilet tank, said weightbox including a baffle which extends traversely therein to divide the interior into a water inlet chamber and a water outlet chamber, a drain hole which communicates with the water outlet chamber, a vent hole, and a water inlet hole which communicates with the water inlet chamber; (b) an attachment means to enable the weightbox to rotate about the generally horizontal axis, (c) a connector means for connecting the weightbox to the control arm of the fill water valve element, and (d) a fresh water infill tube which connects the water inlet hole with a secondary nozzle of the fill water valve element, said manually-operable trip lever mechanism including a trip lever arm which extends within the toilet tank and to which the trip chord is attached, and a lifting arm which is located within the toilet tank and is capable of rotating the weightbox about the generally horizontal axis;

said fill water valve element being connectable with the main water supply pipe and nozzle for delivering fresh water directly into the toilet tank, a secondary nozzle for connection with the fresh water infill tube of the pivotable control element, and a control arm which opens or closes both said primary and secondary nozzles and is connectable with the connector means of the pivotable control element; and said adjustment valve element being connected between the secondary nozzle of the fill water valve element and the weightbox of the pivotable control element for adjusting the flow of fresh water from the fill water valve element to the water inlet chamber of the weightbox.

2. The flush control mechanism as defined in claim 1 wherein the adjustment valve element is needle valve connected between the secondary nozzle of the fill water valve element and the fresh water infill tube of the pivotal control element.

3. The flush control mechanism as defined in claim 1 including the lifting arm of the trip lever mechanism is L-shaped and is pivotally connected to the lever arm.

4. The flush control mechanism as defined in claim 1 including a mounting element positionable in said toilet tank, said mounting element including a support means which provides the generally horizontal axis about which the weightbox pivots.

5. The flush control mechanism as defined in claim 4 wherein said mounting element comprises a plate which is mountable on the rear wall of the toilet tank and a support rod which extends generally perpendicularly away from one of its sides, the support rod providing the generally horizontal axis when the mounting plate is mounted on the rear wall of the toilet tank.

6. The flush control mechanism as defined in claim 5 wherein said mounting element includes vertically positioned upper and lower abutment stops extending away from the same side of the plate as the support rod, these abutment stops coacting with the weightbox to limit its pivotal movement about the support rod.

7. The flush control mechanism as defined in claim 5 wherein said baffle extends transversely of the weightbox at a point about halfway along its length.

8. The flush control mechanism as defined in claim 7 wherein the baffle is tilted in its orientation towards said water outlet chamber.

9. The flush control mechanism as defined in claim 5 wherein said bracket means comprises at least two aligned brackets which extend below the weightbox along a traverse line located about halfway along its length, each bracket including a hole through which the support rod extends.

10. The flush control mechanism as defined in claim 1 wherein the connector means comprises an extension arm which extends away from the side of the weightbox which contains the water outlet chamber and a connector rod, one end of the connector rod being pivotally connected to the extension arm and the other end being attached to the control arm of the fill water valve element.

* * * * *